US006276352B1

(12) United States Patent
Harris et al.

(10) Patent No.: US 6,276,352 B1
(45) Date of Patent: Aug. 21, 2001

(54) BOWFISHING ARROW REST

(76) Inventors: Randall D. Harris, 10420 Hwy. 31 Lot 74; Timothy W. Harris, 10420 Hwy. 31 Lot 72, both of Tanner, AL (US) 35671

( * ) Notice: Subject to any disclaimer, the term of this patent is extended or adjusted under 35 U.S.C. 154(b) by 0 days.

(21) Appl. No.: 09/456,797

(22) Filed: Dec. 8, 1999

(51) Int. Cl.[7] ..... F41B 5/22
(52) U.S. Cl. ..... 124/44.5; 124/24.1
(58) Field of Search ..... 43/6; 124/44.5, 124/41.1, 24.1; F41B 5/22

(56) References Cited

U.S. PATENT DOCUMENTS 4,904,841 * 2/1990 English ..... 219/133
4,949,699 * 8/1990 Gerber ..... 124/44.5
4,957,093 * 9/1990 Hamlett ..... 124/24.1
5,181,502 * 1/1993 Ray ..... 124/44.5
5,421,314 * 6/1995 Kidney ..... 124/44.5
5,456,242 * 10/1995 Ruholl ..... 124/44.5
5,678,530 * 10/1997 Drielen ..... 124/44.5
5,685,287 * 11/1997 Greywall ..... 124/44.5
6,021,769 * 2/2000 Troncoso ..... 124/44.5
6,039,036 * 3/2000 Padilla ..... 124/44.5

* cited by examiner

*Primary Examiner*—Peter M. Poon
*Assistant Examiner*—Son T. Nguyen
(74) *Attorney, Agent, or Firm*—Randall D. Harris; Timothy W. Harris

(57) ABSTRACT

An arrow rest for bowfishing which is comprised of a frame (3) which is a piece of ⅛ inch stainless steel rod with a 90 degree bend in the center and two 45 degree bends to form a symmetrical triangle with 1¹⁄₁₆ inch distances between bends. The joined ends at the center of the hypotenuse of the triangle form a frame joint (4) which is placed on the end of a stud (6), which is stainless steel ⁵⁄₁₆ inch fine threads ½ inch long, in such a manner that a frame (3) is parallel and the hypotenuse is perpendicular with the elongation of a stud (6). A frame (3) has a weld (5) securing it in said position. A setscrew (8) is installed into a modern archery bow (2) from the opposite side of a bowfishing arrow rest (1) so as to lock in place. With another embodiment of this invention, a frame (3) is placed and welded on the end of a stud **(6*a*), which is stainless steel ⁵⁄₁₆ inch fine thread 1½ inch long, in the same manner as above. A nut (9) is used to lock a bowfishing arrow rest (1*a*)** from the opposite side into position.

8 Claims, 4 Drawing Sheets

BOWFISHING ARROW REST

BACKGROUND—FIELD OF INVENTION

This invention relates to archery equipment in general, and more particularly to an extreme abuse arrow rest specifically designed for the sport of bowfishing.

BACKGROUND—DESCRIPTION OF PRIOR ART

Bowfishing is an extremely abusive sport to the equipment that is used. During the coarse of events taken during a fishing trip, the equipment is fully tested for it's durability and effectiveness. During this trip the bow will be dropped repeatedly, stepped on, hit against objects, and other types of extreme abuse. Bowfishing bows generally consist of a modern archery bow with a bowfishing arrow and a nylon cord that is secured to the rear portion of the arrow which is used to retrieve shot game. Some bows use a retrieval reel that is secured to the bow. The arrow is then knocked to the bowstring and ready to shoot. In order to prevent the arrow from falling off the front of the bow during the time between shooting fish, the bowfisherman is required to hold the bow vertically in front of himself, or herself, till the next shot. The other alternative is to place their fore finger over the arrow while holding the bow with the remainder of their hand. Both of these methods are very tiring over a period of time. Sometimes the shooting is very fast paced therefore it is required that the arrow rest be simple and quick to use. Although there are many arrow rest on the commercial market and previous patents, none are suited for the sport of bowfishing.

U.S. Pat. No. 3,760,788 to Hartman (1973) discloses an arrow rest with a "V" shape to rest the arrow upon. This design is not suitable because it has no containment for the arrow when the bow is positioned horizontally. The modern archery bow would require extensive work to mount this rest. The nylon cord secured to the rear portion of the arrow would become entangled on the rest. This rest could easily be damaged from abuse. This is not a suitable bowfishing arrow rest.

U.S. Pat. No. 4,372,282 to Sanders (1983) discloses a flat ring with three radially supporting arms for an arrow and is mounted with two screws on the front or rear of the bows riser. This design is not suitable because it requires extensive work to mount to a modern archery bow. This rest would be easily damaged from abuse. The nylon cord secured to the rear portion of the arrow would become entangled in this arrow rest. This is not a suitable bowfishing arrow rest.

U.S. Pat. No. 4,862,867 to Schmidt (1989) discloses a flat piece of metal that is bent to contain or partially contain an arrow to another piece of metal that is bent to form the rest for the arrow. Both pieces of metal are secured to the bow with screws. This design is not suitable because it requires extensive work to mount to a modern archery bow. This rest would easily be damaged from abuse. The nylon cord secured to the rear portion of the arrow would become entangled in the arrow rest. This rest does not allow for center shot alignment. Center shot alignment is defined as the alignment of the arrow being aligned in the center path of travel of the bow and bowstring. This is not a suitable bowfishing arrow rest.

U.S. Pat. No. 5,025,773 to Hintze et al. (1991) discloses a yoke mounted to rear of a mounting plate and the yoke containing two pedestal mounts for the arrow. The yoke also containing a resilient retaining member to restrict the lateral movement of the arrow. This design is not suitable because this rest would be easily damaged from abuse. The nylon cord that is secured to the rear portion of the arrow would easily become entangled in the rest. This is not a suitable bowfishing arrow rest.

U.S. Pat. No. 5,181,502 to Ray (1993) discloses a mounting plate mounted to the side of the bow with a horizontal support arm extending out with two concave support arms to contain the arrow. It also has a third support arm from the mounting plate to contain the top of the concave support arms. This design is not suitable because this rest would be easily damaged from abuse. The nylon cord that is secured to the rear portion of the arrow would easily become entangled in the rest. This design does not allow for a center shot alignment. This is not a suitable bowfishing arrow rest.

U.S. Pat. Nos. 5,456,242 to Ruholl (1995) discloses a mounting plate with a guide plate that has radially extended slots with sound deadening setscrews positioned between the slots to support the arrow. This is not a suitable rest because this rest would be easily damaged from abuse. The nylon cord that is secured to the rear portion of the arrow would become entangled in the rest. This is not a suitable bowfishing arrow rest.

U.S. Pat. No. 5,678,530 to Van Drielen (1997) discloses a flat planar metal mounted to a commercial mounting arm with flat planar metal being cut out so as to having two launch points for the arrow to rest upon. Also containing the arrow from dislodgement and gravitationally urging the arrow upon the launch points. This design is not suitable because this rest would be easily damaged from abuse. The nylon cord that is secured to the rear portion of the arrow would become entangled in the rest. This design does not allow for a center shot alignment. This is not a suitable bow fishing arrow rest.

Canadian patent 709,190 to John Yasho, Yorkville, Ohio, U.S.A. (1965) discloses a body mounted to the side of the bow with screws that has a lock on a pivoting shaft that entraps the arrow onto the body. This design is not suitable because it requires extensive work to mount to the modern archery bow. This rest would be easily damaged from abuse. The nylon cord that is secured to the rear portion of the arrow would become entangled in the rest. This design does not allow for a center shot alignment. This is not a suitable bowfishing arrow rest.

Accordingly, the standard archery arrow rest currently patented have several disadvantages as shown above. These disadvantages are obviously unacceptable for the sport of bowfishing.

OBJECTS AND ADVANTAGES

Several objects and advantages for this invention are as follows;

(a) To provide a bowfishing arrow rest having the ability to be used with modern archery bows without extensive mounting practices.

(b) To provide a bowfishing arrow rest being of a simple one piece construction and durability to withstand repeatable abuse from hard impacts and abusive treatment.

(c) To provide a bowfishing arrow rest ensuring adequate room to allow for cord passage, and arrow flexibility while maintaining nothing to allow cord to become entangled upon.

(d) To provide a bowfishing arrow rest with the ability to adjust for a proper center shot alignment to maintain the safety and performance of modem archery bows.

(e) To provide a bowfishing arrow rest that is compact, light-weight, simple to use and install.

(f) To provide a bowfishing arrow rest with the ability to contain the arrow regardless of position of the bow and return the arrow to a ready to shoot position when the bow is raised to be shot.

Still further objects and advantages will become apparent from a consideration of the ensuing description and drawings.

DRAWING FIGURES

A setscrew 8 is a 5/16 fine thread ¼ inch long and a nut 9 is a commercially available item made of stainless steel and is shown with this invention. A bowfishing arrow A is shown as a reference to illustrate position.

Figure 1:
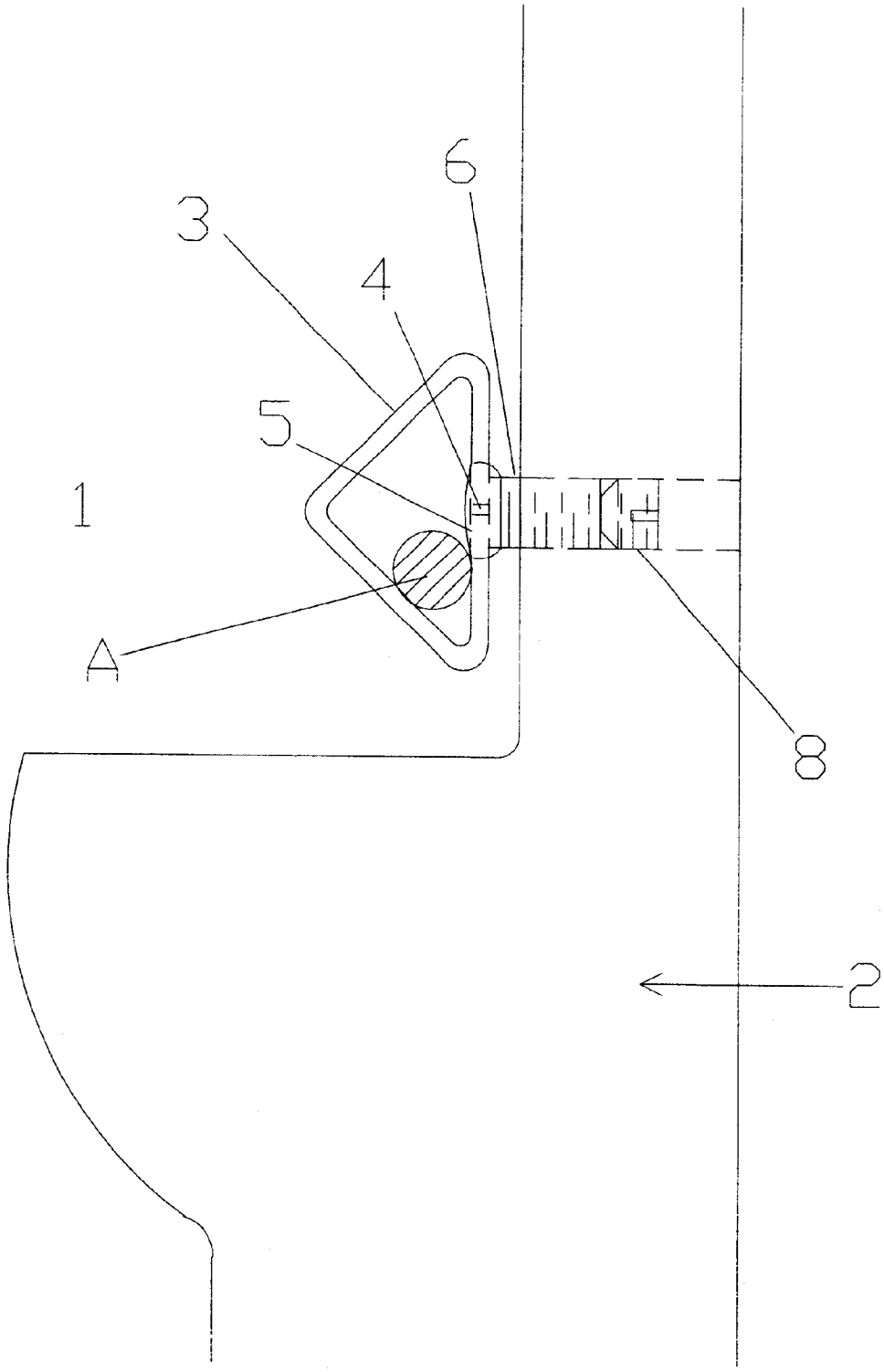
FIG. 1 illustrate the invention of the preferred embodiment as installed to a modern archery bow.

| Reference Numerals In Drawings |
|---|
| 1 bowfishing arrow rest (preferred) |
| 1a bowfishing arrow rest (alternate) |
| 2 modern archery bow |
| 3 frame |
| 4 frame joint |
| 5 weld |
| 6 threaded stud (short) |
| 6a threaded stud (long) |
| 7 threaded hole |
| 8 set screw |
| 9 nut |
| "A" arrow |

SUMMARY

In accordance with the present invention a bowfishing arrow rest comprising a frame secured to a threaded stud, with a locking set screw or nut.

Description—FIGS. 1 to 4

Figure 2:
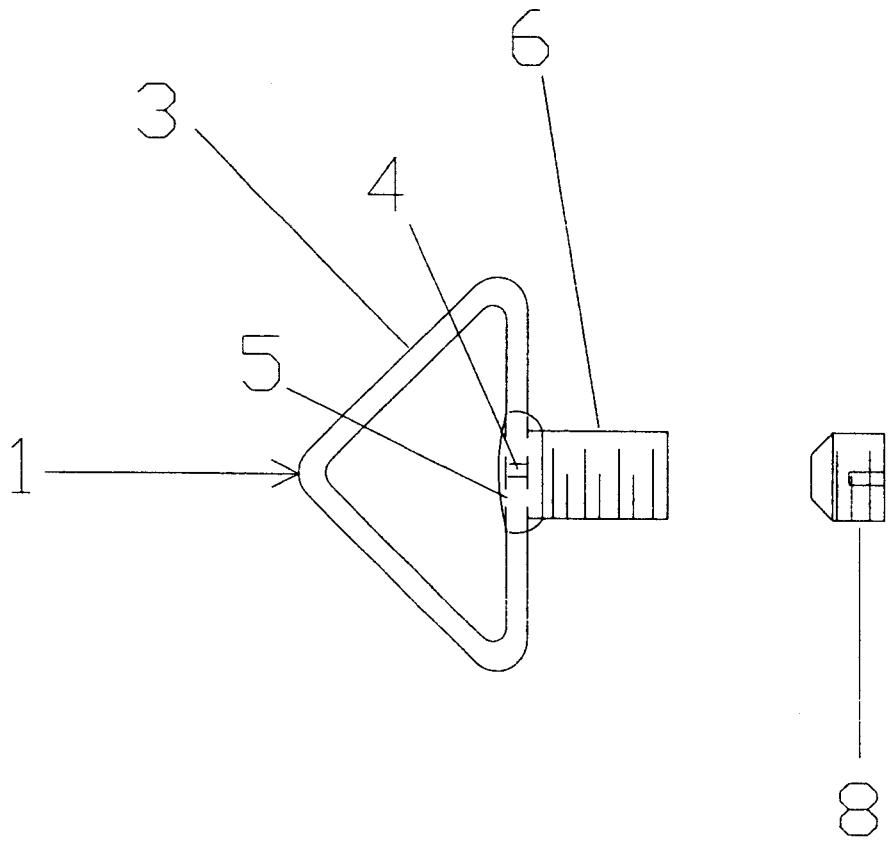
FIG. 2 illustrate the invention of the preferred embodiment in detail as an independent item.

FIG. 1 shows the preferred embodiment of the present invention of a bowfishing arrow rest 1, properly installed to a modern archery bow 2. FIG. 2 shows the preferred embodiment of a bowfishing arrow rest 1 only.

FIG. 2 shows the preferred embodiment of a bowfishing arrow rest 1 with a frame 3 being a triangular symmetric shape. During previous testing of this invention a variety of shapes were tested. Examples of these shapes was a square, rectangle, circular, oval, and other shapes. These other shapes lack the performances that the triangular symmetric shape offered as will be explained in the operation section. Also during previous testing of this invention, different materials were tested. Therefore, a bowfishing arrow rest 1 is made of a weldable grade of stainless steel. Other materials lacked the durability and the cost effectiveness for production that is desired.

A frame 3 is formed from a 3¼ inch piece of weldable stainless steel solid rod which is 1/8 inch in diameter. A smaller rod would not be durable, and a larger rod would inhibit arrow passage. The first bend to form the triangle is the sharply radial 90 degree bend in the center of the rod. The second bend is 1 1/16 inch from the center of the first bend, make a sharply radial bend parallel and inward of the 90 degree bend to form a sharply radial 45 degree bend. The third bend is performed the same as the second bend. Therefore, the ends of the rod from the second and third bends shall come in contact with each other. Excess rod material will overlap each other. To form a frame joint 4 cut excess material at the center of overlapped material. Align each end so as to be parallel with the 90 degree bend and connect each other. Thus, the center of the hypotenuse creates a symmetric triangle of the second and third bend.

Stud 6 made of a weldable stainless steel is cut to ½ inch long from a 5/16 inch fine thread piece of a threaded rod. Stud 6 is required to be made from weldable stainless steel because a frame 3 is made from this material. A weld 5 requires that the two metals to be joined together must be of the same material, and likewise the material used to perform this joining has to be of the same material. Any difference in materials require special welding practices and would not be reasonable.

A frame joint 4 is then placed on the end and on the center of a stud 6 in a relation that is parallel with the 90 degree bend of a frame 3, a frame joint 4, the elongation of a stud 6. Therefore, the hypotenuse of a frame 3 is perpendicular to the threads to a stud 6. A weld 5 is applied using a stainless steel filler, to join a frame 3 to a stud 6 while maintaining their perspective positions as stated above. A weld 5 requires a person to be skilled in the art of welding and likewise be required not leave an excessive build-up of material or any sharp points.

Figure 4:
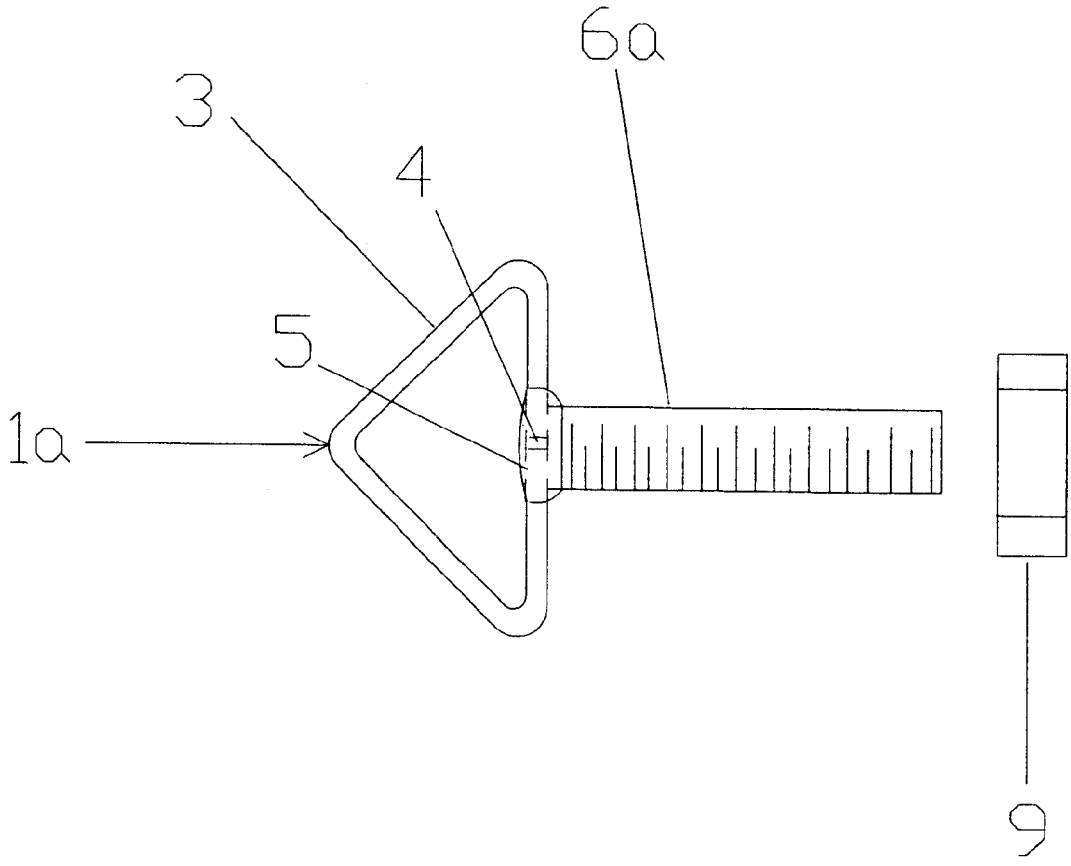
FIG. 4 illustrates the invention of an alternate embodiment in detail as an independent item.

As illustrated in FIG. 4, a frame 3 is positioned and secured to a stud **6*a* in the same manner as said above. A stud 6*a* is of the same material, diameter, and threads as a stud 6 in FIG. 2. The difference of a stud 6*a* illustrated in FIG. 4, is the length of a stud 6*a*** is 1½ inch.

Figure 3:
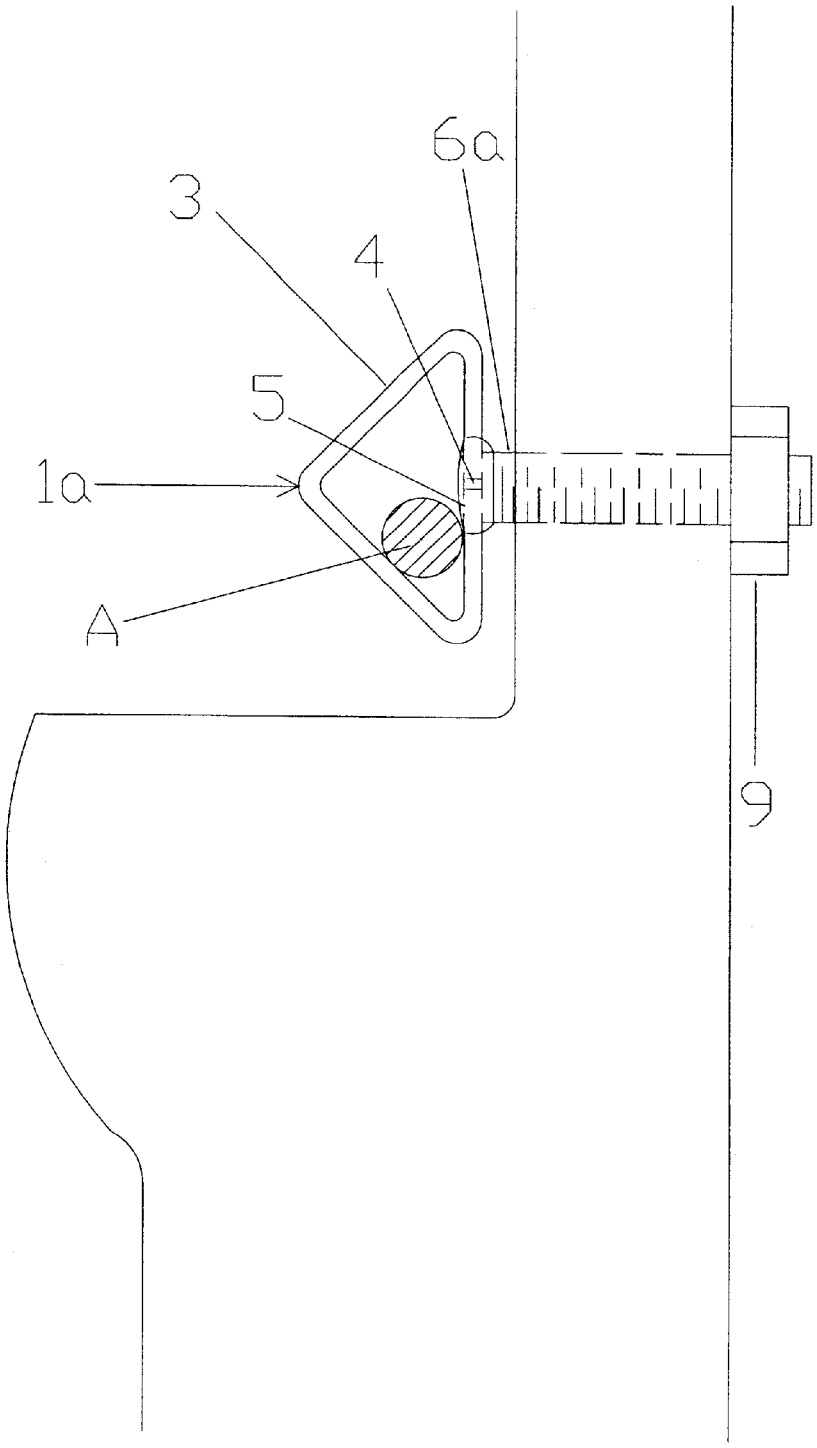
FIG. 3 illustrates the invention of an alternate embodiment as installed to a modern archery bow.

As illustrated in FIG. 1 and FIG. 3, excessive build-up of material or sharp points of a weld 5 could effect an arrow "A" placement and could damage the nylon cord that is secured to the rear portion of an arrow "A". Likewise, a frame 3 requires an inspection to ensure the absence of any sharp edges or marks that could have resulted during bending rod to form triangular shape. FIG. 2 the threaded portion of a stud 6 requires an inspection to ensure threads are not damaged, as also in FIG. 4 of a stud **6*a*. Therefore as illustrated in FIG. 1 a bowfishing arrow rest 1 and FIG. 3 a bowfishing arrow rest 1*a*, will readily thread into a threaded hole 7 which is standard size for the industry of a modern archery bow 2**.

Operation—FIGS. 1, 2, 3, 4

As illustrated in FIG. 1, the method of installation for the preferred embodiment of a bowfishing arrow rest 1 is close to the same as standard archery arrow rest.

After a thorough inspection of a bowfishing arrow rest 1 to ensure that there is nothing to damage the nylon cord that is secured to the rear portion of an arrow "A". And as illustrated in FIG. 2, the threads are not damaged on a stud 6, a bowfishing arrow rest 1 is ready to install. Persons skilled in the art may optionally apply a suitable thread-locker fluid as directed to the threaded portion of a stud 6. The said thread-locker fluid is commercially available which contains directions for usage that are simple to follow.

As shown in FIG. 1, ensure that a threaded hole 7, found in a modern compound archery bow 2, has no thread damage and is empty. A threaded hole 7 is 5/16 inch fine thread hole and will readily accept a stud 6, this is considered standard throughout the archery bow industry. Install a bowfishing arrow rest 1 into a threaded hole 7 in way of clock-wise rotation. Continue clock-wise rotations of a bowfishing arrow rest 1 until the proper center shot alignment is achieved. Center shot alignment is achieved when the center of an arrow "A" is in the center path of travel of the bowstring and bow. The symmetricalness of a frame 3 increases the resolution of the threads of a stud 6. Thereby allowing a center shot adjustment to be at the exact placement within +/−0.0104 of an inch. The said center shot alignment is vital to ensure safe and proper operation for modern high-energy bows. Failure to achieve said center shot alignment can result in equipment failure and personal injury or death. Position the second and third bend of a frame 3 parallel to the bowstring while maintaining center shot alignment.

FIG. 2 illustrates a setscrew 8 which is 5/16 inch fine thread ¼ inch long stainless steel for the purpose of locking a stud 6 in its proper location and not corrode. Optionally, a person may apply the said suitable thread-locker fluid to the threads of a setscrew 8.

FIG. 1 illustrates to install a setscrew 8 into a threaded hole 7 rotating in a clock-wise rotation until a setscrew 8 is fully tighten. Ensure the second and third bends of a frame 3 stays positioned parallel to bowstring.

FIG. 3 illustrates an alternate embodiment of a bowfishing arrow rest 1*a* which is installed in the same manner as the preferred embodiment discussed above. The only difference is to install a nut 9 to the exposed threads of a stud 6*a* to lock a bowfishing arrow rest 1*a* into said position.

Install arrow "A" thru frame 3 rear portion first and nock to the bowstring. Square an arrow "A" to the bowstring and install a nock to the bowstring either above or below the nock of an arrow "A". Persons skilled in the art are familiar with this process.

Secure a nylon cord thru a hole that is pre-drilled in the rear portion of an arrow "A". Install an arrow "A" rear portion first, with nylon cord, and nock to the bowstring. A modern compound archery bow 2 is then ready to shoot. A modern compound archery bow 2 can then be handled in any position and in any safe manner. When ready to shoot, simply raise a modern compound archery bow 2 to normal position, draw back the bowstring, and release the bowstring when ready. Retrieve an arrow "A" with the nylon cord, and reinstall onto a modern archery bow 2.

Conclusion, Ramifications, and Scope

Accordingly, the reader will see that the bowfishing arrow rest of this invention is needed for the individuals in the sport of bowfishing. This need is due to the extreme abuse and the special application of equipment used. A person that is in the sport of bowfishing has a completely different need from his equipment than that of a standard archery hunter or shooter. Therefore a bowfisherman requires a bowfishing arrow rest with advantages that

- can be easily installed in a short amount of time to a modern archery bow.
- can be adjusted to achieve a proper center shot alignment within 0.0104+/− of an inch to ensure proper and safe operations of a modern archery bow.
- can be compact, light-weight, one piece solid construction, and durable to withstand any extreme abuse could be encountered.
- can contain an arrow while maintaining adequate room for cord and arrow passage without the potential risk and dangers of cord entanglement.
- can contain an arrow from falling from a modern archery bow regardless of any position that it is placed, and unassisted, return the arrow to a ready to shoot position when needed.

Although the description above contains many specificities, these should not be construed as limiting the scope of the invention but as merely providing illustrations of the presently preferred embodiment of this invention. For example, the frame can have other shapes and sizes, such as circular, oval, square, rectangular, trapezoidal, etc.; the frame can also be secured to the threaded stud in another fashion, such as spot weld, epoxy, molded, glue, etc.; the bowfishing arrow rest could be made from other materials, such as mild steel, galvanized steel, zinc plated steel, aluminum, carbon composite, etc.; the threaded stud can be secured in position in another fashion, such as use of self-locking threads, expanded threads, interference fit threads, distorted threads, etc.

Therefore, the scope of the invention should be determined by the appended claims and their legal equivalents, rather than by the examples given.

We claim:

1. An arrow rest for bowfishing in which a nylon cord is secured to the rear portion of an arrow, comprising:

a; a frame of which consist of a substantially sized rod of durable material while maintaining substantial clearance for arrow and said cord passage, with a 90 degree bend and two symmetric 45 degree bends to form a symmetric triangle as such to maintain said clearance, to contain said cord with said arrow, prevent said cord entanglement, and reposition arrow, b; said frame is secured at the center of said two symmetric 45 degree bends opposite of the 90 degree bend, to a threaded stud in a manner that said frame is parallel and said center is perpendicular with the elongated surface of said threaded stud, in which said threaded stud is of substantial length of 5/16 inch fine threads to screw into an archery bow without protruding outside of said bow, c; a set screw with similar thread as said threaded stud, of substantial length with the means to screw into outside of said bow and lock said threaded stud into position.

2. The arrow rest of claim 1, wherein said frame be formed in other symmetrical shapes.

3. The arrow rest of claim 1, wherein said arrow rest be comprised of a composite material.

4. The arrow rest of claim 1, wherein said arrow rest be comprised of a form of plastic.

5. An arrow rest for bowfishing in which a nylon cord is secured to the rear portion of an arrow, comprising:

a; a frame of which consist of a substantially sized rod of durable material while maintaining substantial clearance for arrow and said cord passage, with a 90 degree bend and two symmetric 45 degree bends to form a symmetric triangle as such to maintain said clearance, to contain said cord and said arrow, prevent said cord entanglement, and reposition arrow, b; said frame is secured at the center of said two symmetric 45 degree bends opposite of the 90 degree bend, to a threaded stud in a manner that said frame is parallel and said center is perpendicular with the elongated surface of said threaded stud, in which said threaded stud is of substantial length of 5/16 inch fine threads to screw into said archery bows while protruding outside of said bow, c; a nut with similar thread as said threaded stud of substantial size with the means to screw onto said protrusion of said threaded stud and lock said threaded stud into position.

6. The arrow rest of claim 5, wherein said frame be formed in other symmetrical shapes.

7. The arrow rest of claim 5, wherein said arrow rest be comprised of a composite material.

8. The arrow rest of claim 5, wherein said arrow rest be comprised of a form of plastic.

* * * * *